United States Patent [19]

Vogel

[11] Patent Number: 4,602,751

[45] Date of Patent: Jul. 29, 1986

[54] WIRE SPOOL WITH END FLANGE HAVING A WIRE PROTECTING GROOVE

[75] Inventor: Ralph A. Vogel, Three Rivers, Mich.

[73] Assignee: Essex Group, Inc., Fort Wayne, Ind.

[21] Appl. No.: 755,253

[22] Filed: Jul. 15, 1985

[51] Int. Cl.[4] ..... B65H 75/28; B65H 75/18

[52] U.S. Cl. ..... 242/118.4; 242/125.1

[58] Field of Search ..... 242/118, 116, 118.4, 242/118.5, 117, 125–125.3, 164, 165, 170, 171, 118.7, 118.6

[56] References Cited

U.S. PATENT DOCUMENTS

| | | | |
|---|---|---|---|
| 629,115 | 7/1899 | Turney | 242/117 |
| 1,525,503 | 4/1927 | Schooley | 242/125.2 |
| 2,298,357 | 10/1942 | Elvin et al. | 242/125.1 |
| 3,176,932 | 4/1965 | Kovaleski | 242/118.8 |
| 3,368,765 | 2/1968 | O'Grady | 242/25 |
| 3,717,315 | 2/1973 | Kovaleski | 242/125.1 X |
| 4,140,289 | 2/1979 | Kovaleski | 242/118.6 |
| 4,253,569 | 3/1981 | O'Connor et al. | 206/391 |
| 4,387,863 | 6/1983 | Edmonston et al. | 242/118.4 |

*Primary Examiner*—Donald Watkins

*Attorney, Agent, or Firm*—Robert D. Sommer

[57] ABSTRACT

An improved spool for wire having a barrel and frustoconical end flanges, at least one of which is provided on its inner face with a wire protecting groove extending from the smaller diameter inner peripheral end of the one end flange to wire anchoring means at the larger diameter peripheral portion of the end flange. At the inner peripheral end of the end flange, the groove is substantially tangent with the adjacent end of the barrel and thereafter follows such a curved path to its other end which is substantially the shortest course of travel along the inner face of the end flange.

3 Claims, 5 Drawing Figures

FIG. 1
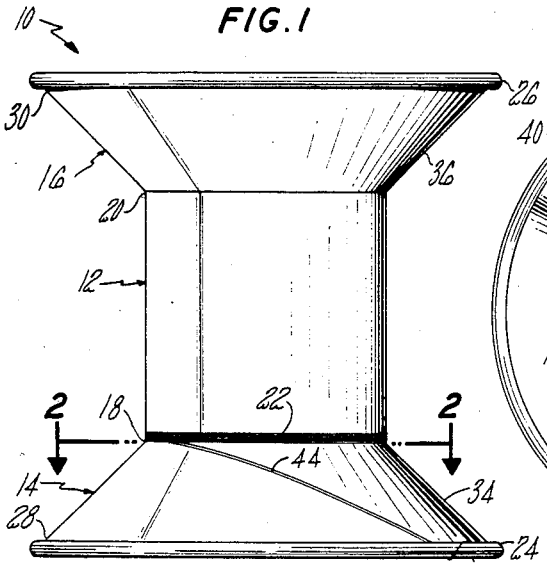
FIG. 2
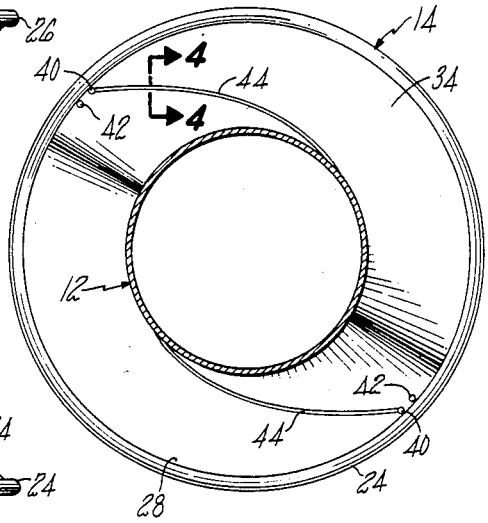
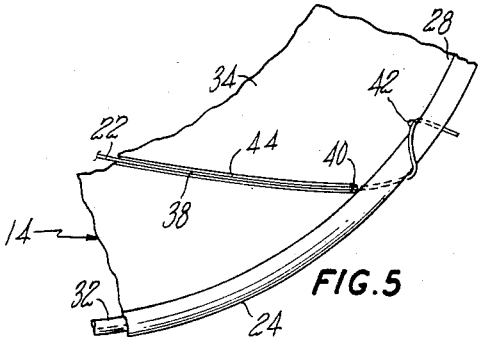
FIG. 5
FIG. 3
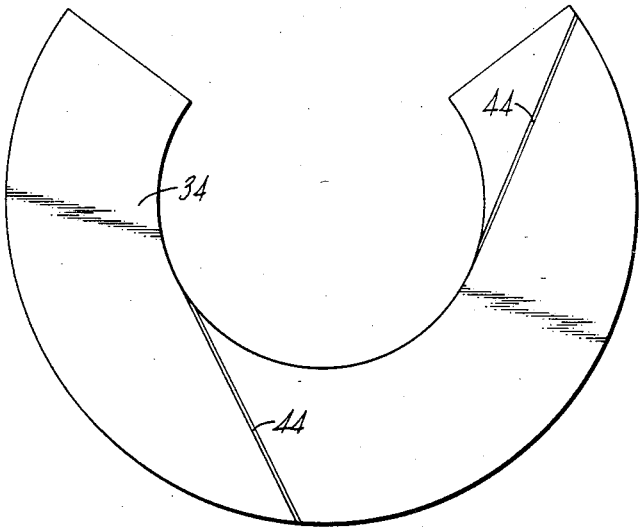
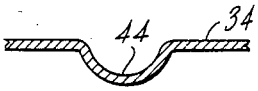
FIG. 4

WIRE SPOOL WITH END FLANGE HAVING A WIRE PROTECTING GROOVE

TECHNICAL FIELD

This invention relates to spools for carrying a substantial weight of wire, and more particularly to spools of the type having tapered or out-turned frustro-conical end flanges at the opposite ends of a generally cylindrical barrel.

BACKGROUND OF THE INVENTION

In the magnet wire industry, it is common practice to wind wire upon large spools having tapered end flanges. One type of spool used for holding large heavy quantities of wire is of a sheet metal construction similar to those disclosed in U.S. Pat. Nos. 3,176,932 and 4,140,289. It is also known to employ large spools of a molded plastic construction similar to that disclosed in U.S. Pat. No. 4,253,569. Wire is commonly dispensed from such spools to a winding device or other wire using equipment in a continuous operation which requires the attachment of wire in one spool to that in another spool. For this purpose, the wire is wound upon the spool in such a manner that a starting length of wire on the spool becomes accessible before the wire on the spool is entirely exhausted. This is usually accomplished by bringing the starting length out along the inside of an end flange from the spool barrel to an external point adjacent the outer periphery of the end flange. However, successive windings of wire wound upon the spool build up against the starting length at an angle. If the wire is of a soft material such as aluminum, the wire may be damaged at the crossover points. Abrasion and indentation of the starting length and end turns of the wire may be sufficiently severe as to make the wire unsuitable for further processing.

For spools with straight end flanges, it was heretofore known to protect the starting length of wire from damage by successive windings by providing a groove on the inner face of the end flange to receive the starting length. In U.S. Pat. No. 3,368,765, it is proposed to employ a wire-receiving groove in one end flange which extends along a chord of the end flange tangential to the spool barrel. Other examples of spools or reels having a groove formed in the inner face of a straight end flange are shown in U.S. Pat. Nos. 629,115, 1,625,503 and 3,398,357.

It is also known to employ a wire receiving groove on the inner face of a tapered end flange of a large spool of the types previously mentioned. In this known spool design, the groove is disposed on the inner face of the end flange along a line of intersection formed by an imaginary cutting plane parallel to the spool axis and extending through a chord of the end flange tangential to the spool barrel. A wire start end hole is formed in the end flange at the end of the groove near the outer periphery of the end flange for anchoring the free end of the starting length of wire to the spool. One disadvantage of this known construction is that the starting length of wire is not always properly retained in the protecting groove, especially when wire is being wound onto the spool at high velocities on the order of 7,000 feet per minute. Under the effect of centrifugal force, the starting length of wire may be forced from the groove and forms a loop, part of which may extend over the inner face of the end flange to be damaged by successive windings of wire. It has also been observed that the starting length of wire may become dislodged from the protecting groove when an inadvertent release in wire tension during winding of the first turns of wire results in one or more turns of wire becoming loose.

SUMMARY OF THE INVENTION

The present invention provides an improved spool with a tapered end flange having a wire protecting groove which overcomes the above-mentioned disadvantages. The groove extends along the inner face of the end flange from the smaller diameter inner peripheral end of the end flange to wire anchoring means at the larger diameter outer peripheral portion of the end flange but along a selected path which assures retention of a starting length of wire in the groove. In accordance with the invention, the groove is substantially tangent at a first end thereof with the end of the spool barrel located at the inner peripheral end of the end flange and thereafter follows such a curved path which is substantially the shortest course of travel between the first end and a point adjacent the wire anchoring means. This selected path extends along a straight line when the surface of revolution defined by the inner face of the end flange is transposed to a flat plane. The groove is preferably concave in cross-section and of sufficient width and depth to fully accommodate wire of the largest size to be wound onto the spool.

For a better understanding of the invention, reference may be had to the following detailed description taken in connection with accompanying drawing, in which:

BRIEF DESCRIPTION OF THE DRAWING

FIG. 1 is a side elevational view of the improved spool as provided by the invention;

FIG. 2 is a sectional view taken along the line 2—2 of FIG. 1;

FIG. 3 is a plan view illustrating the surface of revolution defined by the inner face of the end flange shown in FIG. 2;

FIG. 4 is a partial sectional view on an enlarged scale taken on the line 4—4 of FIG. 2; and FIG. 5 is an enlarged fragmentary view of a portion of FIG. 2 with a wire shown anchored to the rim of the end flange.

DETAILED DESCRIPTION

Referrlng now to the drawing, there is shown a sheet metal spool 10 having a generally cylindrical barrel 12 and a pair of tapered or out-turned end flanges 14 and 16 at respective opposite ends 18 and 20 thereof to define a space into which a substantial weight of wire 22 may be wound. The end flanges 14 and 16 have curled-over rims 24 and 26 at their respective larger diameter, outer peripheral portions 28 and 30. Each of the rims 24 and 26 is preferably reinforced by a continuous ring 32 of steel rod disposed within the rim. The end flanges 14 and 16 have smooth frustro-conical inner faces 34 and 36, respectively, which extend inwardly from the outer peripheral portions of the end flanges to smaller diameter ends contiguous with the ends of the barrel 12. For anchoring the starting end portion 38 of a wire to be wound onto the spool 10, the end flange 14 is formed with two diametrically opposite pairs of wire start holes 40,42 therethrough which are positioned in the outer peripheral portion 28 thereof.

On its inner face 34, the end flange 14 has two wire receiving grooves 44 formed therein, each of which extends continuously from the smaller diameter end of the end flange 14 to a point adjacent a respective one of the wire start holes 40. Each of the grooves 44 is substantially tangential at its inner end with the end 18 of the barrel 12 and thereafter follows a curved path to its outer end which is substantially the shortest course of travel along the inner face 34 between its inner and outer ends. As shown in FIG. 3, each groove 44 extends along a straight line when the surface of revolution defined by the inner face 34 is transposed to a flat plane. Either of the grooves may be employed to receive and protect the starting end portion 38 of wire 22 which is wound onto the spool 10. The grooves 44 preferably are concave in cross-section as illustrated in FIG. 4 and are of sufficient width and depth to fully accommodate wire of the largest size to be wound onto the spool 10.

In use of the spool 10 in a winding operation, an empty spool 10 is placed in winding position with a wire spooling apparatus (not shown) and the starting end portion 38 of wire 22 is anchored to the spool as shown in FIG. 5. To anchor or secure the wire 22 to the spool, the tail end of the wire 22 is inserted through one of the wire start holes 40 from the inner face 34, next looped around the rim 24, then inserted through the adjacent wire start hole 42, and finally bent sharply beneath the hole 42. After one or more turns of the starting end portion 38 of wire 22 are wrapped about the barrel 12, the wire spooling apparatus is actuated to wind successive turns of wire 22 onto the spool. The tension exerted upon the wire 22 upon commencement of winding automatically draws the starting end portion 38 of wire 22 into the groove 44 if not already disposed therein. The starting end portion of the wire 22 within the groove 44 is protected from abrasion and indentation as successive layers of wire build up against the end flange 14. The selected curved path of the groove 44 ensures that the starting end portion 38 of wire 22 will not be displaced from the groove 44 by centrifugal force during rotation of the spool 10 at high winding velocities.

The starting end portion 38 of wire 22 remains protected by the groove 44 when wire 22 is subsequently drawn off the spool 10 to a winding device or other equipment using the wire. Before the wire 22 is completely removed from the spool 10, the tail end of the wire 22 may be disengaged from the wire start holes 40 and 42 and severed from the starting end portion 38 disposed in the groove 44. The wire portion protected by the groove 44 may then be attached to the leading end of wire on another spool to permit drawing wire from one spool after another without interrupting the operation of the winding equipment.

Although the improved spool of the present invention is disclosed as having two wire receiving grooves in one of the end flanges, it will be understood that either or both end flanges of the spool may be provided with one or more such grooves as desired. It will also be evident that the wire receiving grooves may be reversely curved for winding of wire onto the spool in a reversed direction. While the present invention has been specifically disclosed as being incorporated in a sheet metal spool, it is obvious the present invention could be utilized with spools of other materials. It will also be recognized that alternate forms of anchoring means such as clips or knobs may be utilized for anchoring the starting end portion of wire to the spool.

What is claimed is:

1. In a spool comprising a generally cylindrical barrel having a first out-turned end flange at one end thereof and a second out-turned end flange at the other end thereof to define a winding space into which a substantial weight of wire may be wound, said first end flange having an outer peripheral portion provided with means for anchoring the free end of the starting end portion of the first turn of wire which may be wound about said barrel, said first end flange further having a smooth frustro-conical inner face extending inwardly from said outer peripheral portion to a smaller diameter peripheral end which is contiguous with said one end of the barrel; the improvement wherein said first end flange is provided on said inner face with a groove extending continuously from said inner peripheral end to a point adjacent said wire anchoring means; said groove being substantially tangential at a first end thereof with said one end of the barrel and thereafter following such a curved path which is substantially the shortest course of travel along said inner face between said first end and said point adjacent said wire anchoring means.

2. The invention of claim 1 wherein said groove extends along a straight line when the surface of revolution defined by said inner face is transposed to a flat plane.

3. The invention of claim 2 wherein said groove is concave in cross-section and is of sufficient width and depth to fully accommodate wire of the largest size to be wound on to the spool.

* * * * *